US006338753B1

(12) United States Patent
Margaria et al.

(10) Patent No.: US 6,338,753 B1
(45) Date of Patent: Jan. 15, 2002

(54) POWDER PRODUCT TO PROTECT MOULDS FOR THE CENTRIFUGAL CASTING OF CAST IRON TUBES AND METHOD OF PREPARING THIS PRODUCT

(75) Inventors: Thomas Margaria, Passy; Roland Siclari, Liverdun, both of (FR)

(73) Assignee: Pechiney Electrometallurgie, Courbevoie (FR)

( * ) Notice: Subject to any disclaimer, the term of this patent is extended or adjusted under 35 U.S.C. 154(b) by 0 days.

(21) Appl. No.: 09/225,317

(22) Filed: Jan. 5, 1999

(30) Foreign Application Priority Data

Jan. 16, 1998 (FR) ..... 98 00628

(51) Int. Cl.[7] ..... C01B 33/037; B22C 1/00; B22C 3/00; B22C 9/00

(52) U.S. Cl. ..... 106/38.22; 106/38.27; 106/38.28; 75/305; 75/314; 75/230; 75/232; 75/243

(58) Field of Search ..... 106/38.22, 38.27, 106/38.28; 75/305, 314, 230, 232, 243

(56) References Cited

U.S. PATENT DOCUMENTS 4,058,153 A 11/1977 Pierrel 5,783,509 A * 7/1998 Manier ..... 501/92

FOREIGN PATENT DOCUMENTS

| | | |
|---|---|---|
| EP | 0201200 | 11/1986 |
| EP | 0675077 | 10/1995 |
| EP | 0727389 | 8/1996 |
| EP | 0786532 | 1/1997 |
| WO | 95/26926 | 10/1995 |
| WO | 95/27086 | 10/1995 |

* cited by examiner

*Primary Examiner*—Michael Marcheschi
(74) *Attorney, Agent, or Firm*—Dennison, Scheiner, Schultz & Wakeman

(57) ABSTRACT

Powder product for the protection of molds for centrifugal casting of cast iron tubes, and a method for its production. The powder contains a mixture of a silicon-based inoculating agent and a mineral powder, the silicon-based inoculating product comprising waste masses from synthesis of alkyl- or aryl- halosilanes, from which tin and optionally copper has been removed. The mineral powder may contain at least one material selected from the group consisting of carbon and a fluoride.

11 Claims, No Drawings

POWDER PRODUCT TO PROTECT MOULDS FOR THE CENTRIFUGAL CASTING OF CAST IRON TUBES AND METHOD OF PREPARING THIS PRODUCT

BACKGROUND OF THE INVENTION

The present invention relates to a product in powder form intended to protect moulds (often termed "shells") for the centrifugal casting of cast iron tubes.

DESCRIPTION OF RELATED ART

The products used for the protection (or lining) of shells for the centrifugal casting of cast iron tubes are in powder form containing an inoculating alloy intended to treat the outer surface of the tube. This alloy is most often ferro-silicon based, possibly alloyed with calcium, aluminium and/or strontium and possibly other elements such as manganese and zirconium. The silicon and calcium may also be added in the form of a silicon-calcium alloy. They also contain inert mineral powders such as carbon, silica, fluorspar and other fluoride compounds whose role is to aid withdrawal of the tube after casting. For centrifugal casting of cast iron tubes, U.S. Pat. No. 4,058,153 (Pont-a-Mousson) for example describes the use of a lining made of a mixture of silica and bentonite and a thin layer of inoculate, for example ferro-silicone.

Industrial synthesis of silicones is made from alkyl or arylhalosilanes, in particular dimethyldichlorosilane, obtained by reaction of a contact mass containing powdered metallurgical silicon with methyl chloride at a temperature of between 300 and 350° C. in the presence of a catalyst containing copper and optionally tin. This reaction known under the name Rochow reaction is used worldwide and leaves considerable quantities of residues, termed waste contact masses, in the form of sludge containing various metal elements in silicide, silicate or oxide form.

These waste masses which are no longer reactive under Rochow reaction conditions, remain reactive to air and they must be rendered passive prior to their disposal as waste. There are numerous methods, generally consisting of oxidizing the product either in air or in an aqueous medium. Hence, U.S. Pat. Nos. 4,892,694 and 5,126,203 by General Electric suggest stabilizing the waste masses in the form of pellets impregnated with an organic binding agent such as lignine. U.S. Pat. No. 5,274,158 by the same company suggests treating the residues by heating to between 900 and 1500° C. in an inert atmosphere, and patent EP 0601796 suggests heating to between 400 and 800° C. in an oxygen atmosphere.

Other methods have been put forward in an attempt to recycle the waste masses into products that can be re-used, avoiding their disposal as waste. For example WO 95/27086 by Elkem describes the treatment of waste masses in an electric arc furnace to collect the silicon and copper. Patent application EP 0786532 by Elkem describes the manufacture of bricks made up of silicon-based residues mixed with carton, hydraulic cement and a ferro-alloy than can be used as a metallurgical additive. Patent application EP 0794160 by the applicant describes the recycling of waste masses in the form of a refractory powder containing silicon nitride which, when mixed with an organic binding agent, can be used as stoppers for casting holes in blast furnaces or electric metallurgy furnaces. It nevertheless remains necessary, given the considerable development in the production of silicones, to find other possibilities for recycling waste masses.

SUMMARY OF THE INVENTION

The object of the invention is a powder product to protect moulds for the centrifugal casting of cast iron tubes, made up of a mixture of mineral powders and a silicon-based inoculating agent for the cast iron, characterized in that one part at least of the silicon is derived from waste masses of silicon produced by the synthesis of alkyl or arylhalosilanes. The inoculating agent may be ferro-silicon based or it may contain another silicon alloy comprising for example aluminium, calcium, barium, strontium, manganese and/or zirconium.

The invention also relates to a method for manufacturing a powder product to protect moulds for the centrifugal casting of cast iron tubes, consisting of:

a) treating a waste mass derived from the synthesis of alkyl or aryl-halosilanes to remove their tin and possibly their copper content, b) adding silicon or silicon alloy powder to the treated mass such that its silicon content can be adjusted to a pre-set value, c) possibly incorporating into the mixture, if the silica content is less than a pre-set value, a mineral powder that is inert vis-à-vis the other components, such as silica, carbon or fluorspar.

DETAILED DESCRIPTION OF THE INVENTION

If the waste masses collected on exiting the reactor contain tin derived from the catalyst used in the Rochow reaction, they are first treated with for example a sulphuric acid solution containing 15 to 50% by weight of pure acid at a temperature of between 20 and 100° C. The tin and copper are removed in the form of sulphates which may be re-used. The insoluble fraction, namely the purified mass is then dried and has the form of a powder with a grain size of less than 0.1 mm.

Depending upon the origin of the waste mass and reaction conditions, the non-oxidized silicon content varies considerably, and this variability is a major obstacle to its recycling in industrial applications which require minimum reproducibility. To make a product for the protection of moulds for the casting of cast iron tubes which has similar properties of use to those commonly used, it is necessary to adjust the silicon titre by adding ferro-silicon or a silicon alloy containing up to 5% of one or more elements such as calcium, aluminium, barium, strontium, manganese or zirconium such that an inoculating capacity can be maintained that is more or less constant vis-à-vis the cast iron.

The final mixture is then prepared having a grain size of less than 200 $\mu$m, through the addition of an inert mineral powder containing for example carbon, fluorspar or other fluoride compounds or silica, taking into consideration the silica already provided by the waste mass which may in some cases prove to be sufficient thereby avoiding any further addition.

To successfully conduct these two successive mixing operations, the quality obtained must be controlled at each stage of the process, which assumes the availability of an evaluation test for the inoculating property of the base material, and a specific application test for the protection of the shells for centrifugal casting.

To test the inoculating power of the base material, that is to say the mixture of the purified waste mass and the inoculating alloy with added silicon, a crucible of pig iron is treated in an induction furnace with the addition of 1% by weight of the base material, and it is then cast into a sand mould to obtain test pieces of different thicknesses. Using optical microscopy, the temper thickness of these test pieces is measured, that is to say the thickness of the skin of perlite structure around the core of the piece whose structure is ferritic.

For the specific assessment of the adequation of the final product for the protection of tube casting moulds, liquid iron is cast into a fixed cylinder mould with a vertical axis in porous sintered metal whose outer part is surrounded with a sealed casing to allow vacuum drawing on the outer part of the mould. With this system it is possible to maintain the protective powder that is to be tested on the inner surface of the mould, thereby preventing this powder from being swept away by the flow of liquid iron at the time of casting. A cylindrical core in agglomerated sand placed in coaxial position will provide toric shape simulating the shape of a tube. The inner surface of the mould is made at an angle of 2 degrees to facilitate removal from the mould. The quality of the tested products is determined in relation to mould withdrawal time of the piece under the sole accent of gravity, and to temper depth observed on the outer skin of the piece. The test is conducted with constant titration of the product to be tested at 200 g/m2/ The liquid iron required for the test is previously treated at 1550° C. through the addition of 14 g/kg of nickel-magnesium alloy containing 15% magnesium.

EXAMPLES

A first test is conducted by preparing a powder with a grain size of between 50 and 200 $\mu$m of an alloy having the following composition (by weight): Si=62.4%, Ca=2.1%, Ba=1.85%, Al=0.91%, Mn=0.26%, Zr=0.11%, remainder Fe.

The inoculating capacity of this alloy is tested by treating 3 kg of Sorel pig iron melted at 1400° C. in an induction furnace with 30 g of alloy, and by casting this smelt within 5 minutes after treatment into a sand mould to obtain test-pieces 20, 10, 5 and 2 mm thick. It is observed that the structure of the test-pieces is entirely of perlite type for the two thinnest pieces, the perlite thickness being 3 mm on the 20 mm test piece, and 4 mm on the 10 mm test-piece.

A mixture is then prepared made up of 90% by weight of the previous inoculating alloy and 10% powdered silica with a grain size of between 50 and 100 $\mu$m. This mixture is tested as a mould protection in a vertical cylindrical mould having a diameter of 90 mm and a height of 130 mm, with a central core in graphite whose diameter is 70 mm. The piece obtained withdraws from the mould, under gravity, 20 s after the end of casting, and the perlite thickness on the outer surface is 2 mm.

Example 2

Residues from the manufacture of dichloromethylsilane were collected on exiting a synthesis reactor and were treated with a sulphuric acid solution to remove their tin and copper content. The collected, dried, insoluble fraction is in powder form with a grain size of less than 50 $\mu$m having a composition (by weight) of: Si=38%, $FeSi_{2,4}$=21%, $SiO_2$=24%, C=9%, SiC=3%, $Al_2O_3$=2%, Ti=1%.

40 g of this powder are mixed with 60 g of 75% ferro-silicon having a composition (by weight) of: Si=76.3%, Al=0.78%, Ca=0.4%, the remainder mostly being iron. The mixture is tested as inoculant under the same conditions as in example 1. It is observed that the structure of the test-pieces is totally perlite for the thicknesses of 2 and 5 mm, and that perlite thickness is respectively 3 and 2 mm for the 10 and 20 mm test-pieces.

The mixture, with no other product added, is then tested as a protection product for tube casting shells under identical conditions to those in example 1. The cast piece withdraws from the mould 18 s after the end of casting and the perlite thickness on the outer surface was measured to be 1.5 mm. It is therefore found that this product provides slightly better protection than in example 1.

What is claimed is:

1. Powder product for the protection of molds for centrifugal casting of cast iron tubes formed by a method consisting essentially of:

a) treating a waste mass derived from synthesis of alkyl- or aryl- halosilanes to remove any tin present, and optionally, any copper present, and producing thereby a powder;

b) optionally, adding to said treated waste mass powder an amount of silicon or silicon alloy necessary to adjust silicon content of the waste mass to a predetermined value; and c) mixing said treated waste mass powder with an inert mineral powder comprising at least one material selected from the group consisting of silica, carbon and a fluoride, to obtain thereby said powder product having a grain size less than 200 $\mu$m.

2. Powder product according to claim 1, wherein a silicon alloy comprising ferrosilicon is added.

3. Powder product according to claim 1, wherein a silicon alloy comprising at least one of the elements aluminum, calcium, barium, strontium, manganese and zirconium in an amount of no more than 5% by weight is added.

4. Powder product according to claim 1, wherein the mineral powder comprises silica.

5. Powder product according to claim 1, comprising silica which is derived entirely from said waste masses.

6. Powder product for the protection of molds for centrifugal casting of cast iron tubes, comprising a mixture of a silicon-based inoculating agent and a mineral powder, wherein at least a portion of the silicon contained in the silicon-based inoculating product is derived from waste masses from synthesis of alkyl- or aryl- halosilanes, and wherein the mineral powder contains at least one material selected from the group consisting of carbon and a fluoride.

7. Powder product according to claim 6, wherein the fluoride is fluospar.

8. Method for preparing a powder product for protection of molds for centrifugal casting of cast iron tubes, consisting essentially of the steps of:

a) treating a waste mass derived from synthesis of alkyl- or aryl- halosilanes to remove any tin present, and optionally, any copper present, and producing thereby a powder; and b) optionally, adding to said treated waste mass powder an amount of silicon or silicon alloy necessary to adjust silicon content of the waste mass to a predetermined value; and c) mixing said treated waste mass powder with an inert mineral powder comprising at least one material selected from the group consisting of silica, carbon and a fluoride, to obtain thereby said powder product having a grain size less than 200$\mu$m.

9. Method according to claim 8, wherein the silicon alloy added to the treated waste mass comprises ferrosilicon.

10. Method according to claim 8, wherein the silicon alloy comprises at least one of the elements aluminum, calcium, barium, strontium, manganese and zirconium in an amount of no more than 5% by weight.

11. Method according to claim 8, wherein the fluoride is fluospar.

* * * * *